United States Patent [19]

Murasaki

[11] 4,331,181

[45] May 25, 1982

[54] SELVAGE-KNITTING NEEDLE MECHANISM FOR USE IN A SHUTTLELESS LOOM

[75] Inventor: Ryuichi Murasaki, Tateyama, Japan

[73] Assignee: Yoshida Kogyo K.K., Tokyo, Japan

[21] Appl. No.: 176,014

[22] Filed: Aug. 7, 1980

[30] Foreign Application Priority Data

Aug. 28, 1979 [JP] Japan ..... 54-109327

[51] Int. Cl.[3] ..... D03D 47/42

[52] U.S. Cl. ..... 139/431

[58] Field of Search ..... 139/431, 432

[56] References Cited

U.S. PATENT DOCUMENTS

| | | | |
|---|---|---|---|
| 96,564 | 11/1869 | Duckworth | 139/431 |
| 3,102,557 | 9/1963 | Gustavson et al. | 139/431 |
| 3,788,361 | 1/1974 | Kronoff et al. | 139/431 |
| 3,929,170 | 12/1975 | Muller | 139/431 |
| 3,978,895 | 9/1976 | Murasaki | 139/431 |

FOREIGN PATENT DOCUMENTS

| | | | |
|---|---|---|---|
| 2048543 | 4/1971 | Fed. Rep. of Germany | 139/431 |
| 2022629 | 12/1979 | United Kingdom | 139/431 |

*Primary Examiner*—Henry Jaudon

*Attorney, Agent, or Firm*—Hill, Van Santen, Steadman, Chiara & Simpson

[57] ABSTRACT

A selvage-knitting needle for use in a shuttleless loom is attached at an angle to a support bar which is angularly movable by rocker means to enable an intersection of the axes of the needle and support bar to substantially follow an arc of a circle. A pivot means allows the support bar to move longitudinally substantially through a point on the circle while the support bar is being angularly moved, so that the selvage-knitting needle can reciprocate through a fixed point adjacent to the fell of a tape being woven for knitting a tight selvage.

7 Claims, 6 Drawing Figures

SELVAGE-KNITTING NEEDLE MECHANISM FOR USE IN A SHUTTLELESS LOOM

BACKGROUND OF THE INVENTION

1. Field of the Invention

The present invention relates to a selvage-knitting needle mechanism for use in a shuttleless loom for weaving a narrow fabric such as a slide fastener stringer tape.

2. Prior Art

Weaving a narrow fabric or tape on a shuttleless loom requires that the selvage-knitting needle catch a weft loop inserted through a warp shed and projected therefrom, and draw the engaged weft loop through a previous weft loop on the needle, thereby knitting a selvage along an edge of the tape being woven. To perform this task, it is necessary that the selvage-knitting needle reliably engage or catch such projected weft loops without fail.

A variety of selvage-knitting needle mechanisms have been devised to meet such requirements. For example, U.S. Pat. No. 3,102,557, patented Sept. 3, 1963 discloses a selvage-knitting needle that moved upwardly as it moves rearwardly until its hook is above an inserted weft loop, which is then engaged by the hook when the needle starts moving forwardly and downwardly. The upward movement of the needle, however, causes a previous weft loop on a needle shank thereof to be pulled upwardly and enlarged excessively, with the results that the resulting selvage can be irregular in shape, loose, and unsightly. To solve such a disadvantage, a driving mechanism shown in U.S. Pat. No. 3,978,895, patented Sept. 7, 1976, enables the shank of a selvage-knitting needle to be held substantially in a vertical sense whereas the hook moves up and down for reliable weft-loop catching as the needle reciprocates back and forth. The disclosed driving mechanism, however, comprises a complex linkage which is not suitable for a highspeed operation.

SUMMARY OF THE INVENTION

A support bar to which a selvage-knitting needle is attached at an angle is angularly movable by rocker means to enable an intersection of the axes of the needle and support bar to substantially follow an arc of a circle. While the support bar is being angularly moved, it is allowed by a pivot means to move longitudinally substantially through a point on the circle, so that the selvage-knitting needle can reciprocate substantially through a fixed point on the circle adjacent to the fell of a tape being woven for knitting a tight selvage.

An object of the present invention is to provide a selvage-knitting needle mechanism for forming a tight and sightly selvage along a tape edge at a high speed.

Another object of the present invention is to provide a selvage-knitting needle mechanism which is relatively simple in structure.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
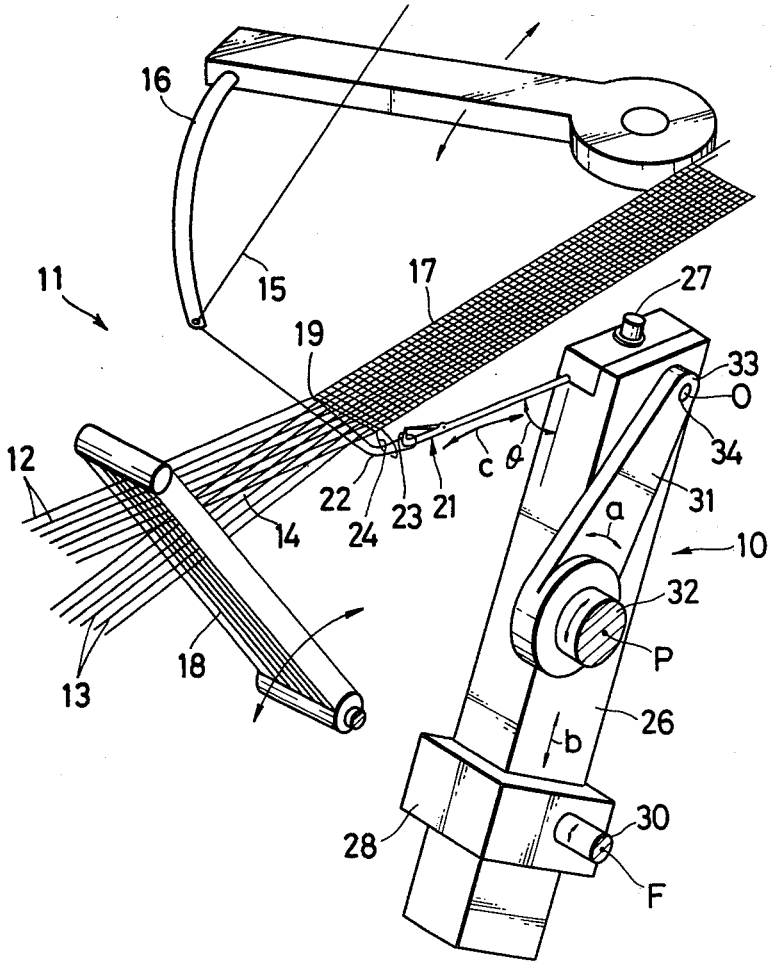
FIG. 1 is a perspective view of a selvage-knitting needle mechanism according to the present invention.
Figure 2:
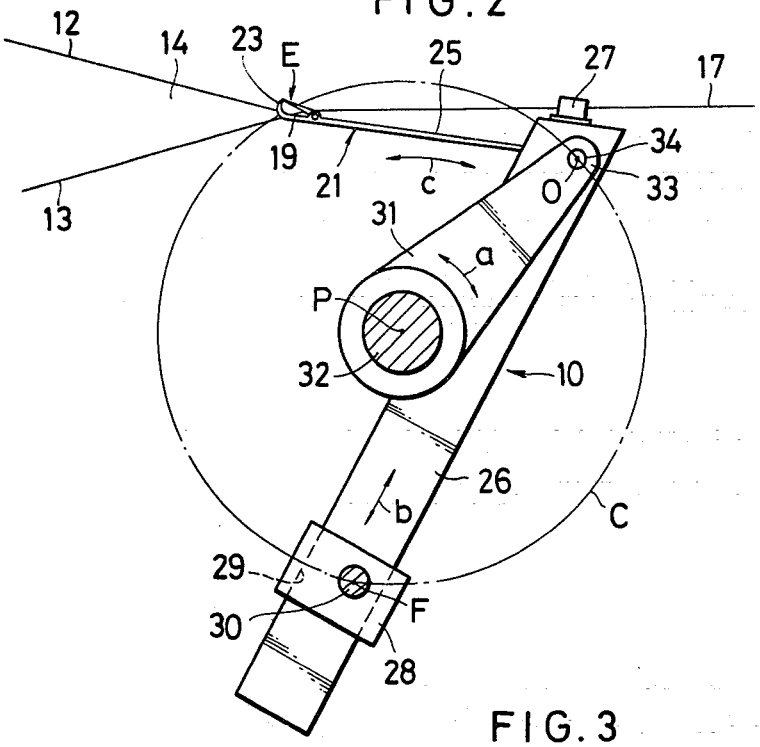
FIG. 2 is a side elevational view of the selvage-knitting needle mechanism shown in FIG. 1.

The principles of the present invention are particularly useful when embodied in a selvage-knitting needle mechanism such as shown in FIGS. 1 and 2, generally indicated by the reference numeral 10. The selvage-knitting needle mechanism 10 is incorporated in a shuttleless or ribbon loom 11 for weaving a ribbon or a narrow fabric, the shuttleless loom 11 including harnesses (not shown) for raising and lowering selected groups of parallel warp threads 12, 13 to form a succession of sheds 14 in which loops of a weft thread 15 are placed by a reciprocating weft inserter 16 thereby weaving a narrow fabric 17 for use as a slide fastener stringer tape, for example. A reed 18 beats the inserted weft loops into a fell 19 of the fabric 17 being woven.

The selvage-knitting needle mechanism 10 comprises a selvage-knitting needle 21 in the form of a latch needle having a hook 23 for catching a weft loop 22 inserted through the shed 14, and for drawing the weft loop 22 through a previous weft loop which has been on a shank 25 thereof and which is then cast off the needle 21. The needle 21 is attached at an angle $\theta$ to a support bar 26 by a screw 27. The support bar 26 is guided for longitudinal reciprocating movement by a pivotable guide 28 having a hole 29 through which the support bar 26 is slidably received. The guide 28 has a pin 30 pivotably mounted on a loom frame (not shown). A pivotable lever 31 is supported on a shaft 32 which is pivotably mounted on the loom frame for being angularly reciprocably moved by a suitable drive mechanism (not shown) that may be of any known structure. The lever 31 is pivotably connected at its distal end 33 to the support bar 26 by a pin 34 located substantially at the intersection of the axes of the needle 21 and support bar 26.

The parts mentioned above of the selvage-knitting needle mechanism 10 are dimensioned such, as shown in FIG. 2, that the pin 30 has an axis F located at a point on a circle C which can imaginarily be followed by the axis O of the pin 34 when the latter is angularly moved by the lever 31 which is pivotably moved about the axis P of the shaft 32, whereas the needle 21 intersects the circle C at a point E adjacent to the fell 19, where selvage knitting is carried out.

When the shaft 32 is angularly moved back and forth in the directions indicated by the arrow a through a predetermined angle, the support bar 26 is caused to angularly move about the pin 30 in the directions of the arrow c and at the same time to reciprocate longitudinally through the guide 28 in the directions of the arrow b. The needle 21 moves with the support bar 26 back and forth along an arc while tilting up and down, and yet passes through the point E which remains vertically stationary at all times, so that weft loops knitted by the needle 21 are kept tight and firm.

Figure 3:
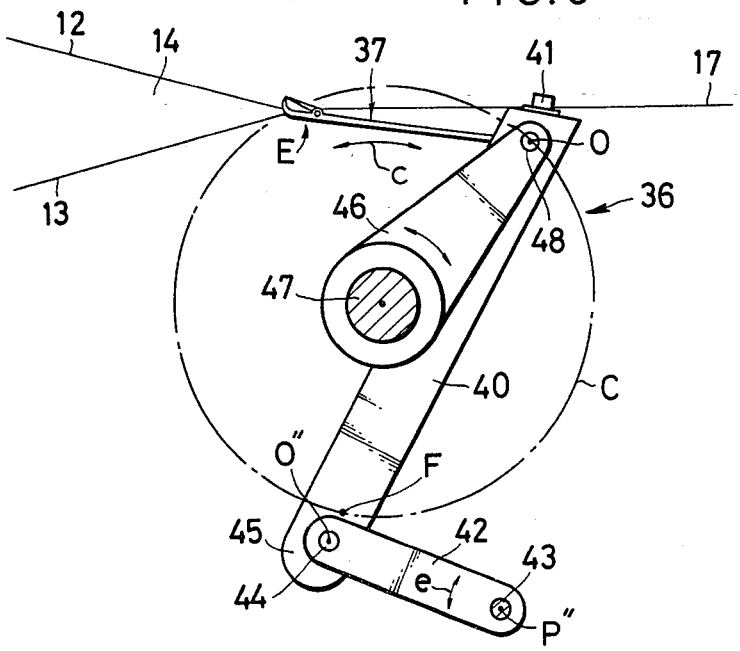
FIG. 3 is a side elevational view of a selvage-knitting needle mechanism according to a second embodiment.

A selvage-knitting needle mechanism 36 according to a second embodiment shown in FIG. 3 comprises a selvage-knitting latch needle 37 attached to a support bar 40 by a screw 41. A lever 42 is supported by a pin 43 pivotably mounted on a non-illustrated loom frame and is pivotably attached by a pin 44 to an end portion 45 of the support bar 40. The support bar 40 is driven for angular movement and longitudinal reciprocation by a pivotable lever 46 mounted on a drive shaft 47 and pivotably attached to the support bar 40 by a pivot pin 48 located substantially at the intersection of the axes of the needle 37 and support bar 40. With such an arrangement, the support bar 40 is caused by angular movement of the lever 46 to angularly move and simultaneously longitudinally reciprocate as the lever 42 is angularly moved about the pin 43 in the direction of the arrow e, the axis of the support bar 40 passing substantially through a point F on a circle C that is imaginarily describable by the axis O of the pin 48 when angularly moving along an arc of the circle C about the shaft 47. The needle 37 is enabled to intersect the circle C at a point E which remains substantially vertically stationary while the needle 37 reciprocates along an arc with pivotal movement of the lever 46. In this embodiment, the pin 43 is located out of the circle C.

Figure 4:
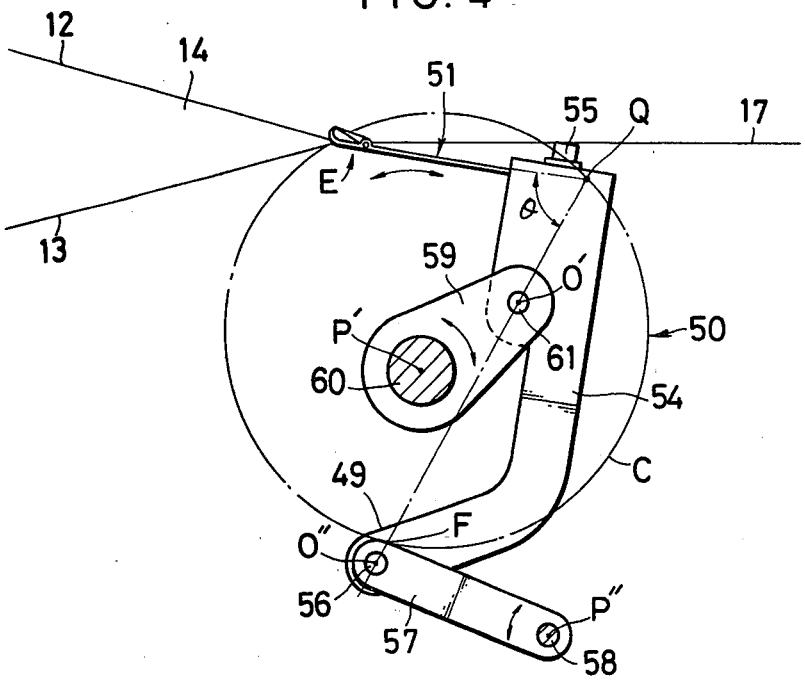
FIG. 4 is a side elevational view of a selvage-knitting needle mechanism according to a third embodiment.

FIG. 4 illustrates a third embodiment in which a selvage-knitting needle mechanism 50 comprises a selvage-knitting latch needle 51 attached by a screw 55 to a curved support bar 54 substantially in the shape of a J having a distal end portion 49 pivotably connected by a pin 56 to a lever 57 which is pivotably connected by a pin 58 to a non-illustrated loom frame. A pivotable lever 59 is supported on a drive shaft 60 pivotably mounted on the loom frame and is pivotably connected by a pin 61 to the support bar 54 remotely from the needle 51. When the drive lever 59 is caused to pivot to and fro, the intersection Q of the axis of the needle 51 and the line extending through the axes O', O'' of the pins 61, 56 substantially follows an arc of a circle C to enable the needle 51 to reciprocate longitudinally through a vertically stationary point E on the circle C. The support bar 54, while being angularly moved, is allowed to move vertically by the lever 57 as the latter pivots about the pin 58. With this arrangement, the shaft 60 has an axis P' located eccentrically with respect to the circle C.

Figure 5:
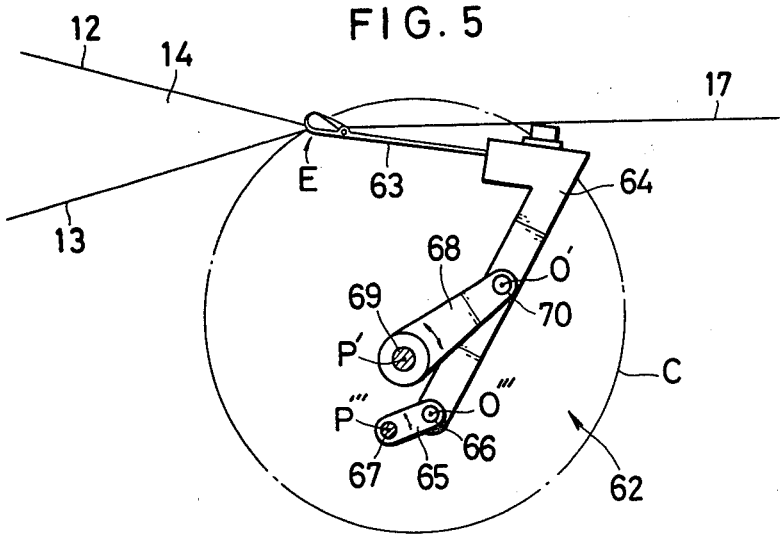
FIG. 5 is a side elevational view of a selvage-knitting needle mechanism according to a fourth embodiment.

According to a fourth embodiment shown in FIG. 5, a selvage-knitting needle mechanism 62 comprises a selvage-knitting latch needle 63 attached to a support bar 64 pivotably connected at a distal end thereof by a pin 66 to a lever 65 which is supported on a pin 67 pivotably mounted on a loom frame (not shown). A pivotable lever 68 is supported on a drive shaft 69 which is driven for angularly moving the lever 68 back and forth. The pivotable lever 68 is pivotably connected by a pin 70 to the support bar 64 remotely from the needle 63. Upon pivotal movement of the lever 68, the support bar 64 is angularly moved to enable the intersection of the axes of the needle 63 and support bar 64 to follow an arc of a circle C, and at the same time is caused by the lever 65 to move back and forth longitudinally. The needle 63 passes substantially through a fixed point E on the circle C during such swinging movement of the support bar 64. The pin 67 is located within the circle C according to the embodiment of FIG. 5.

Figure 6:
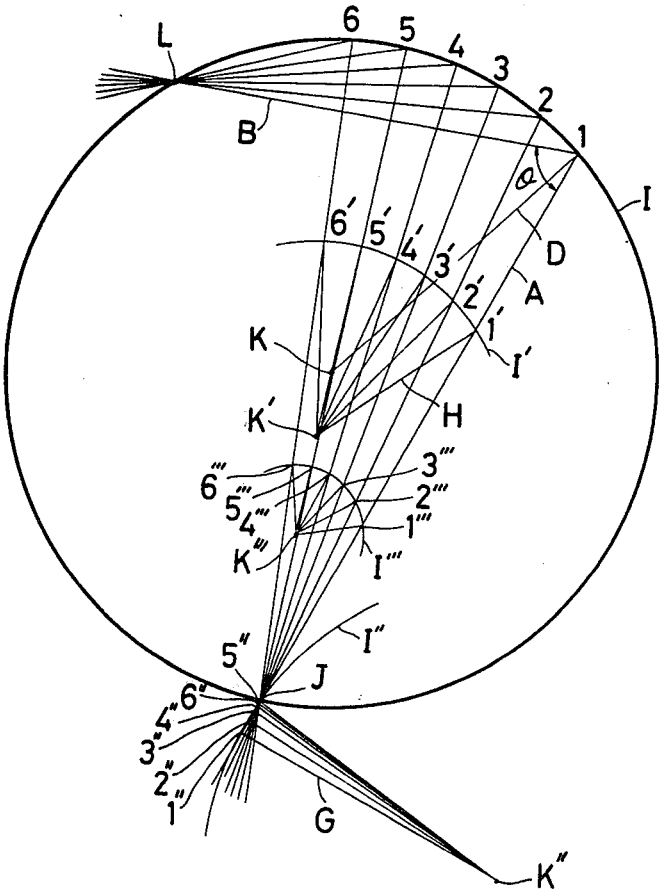
FIG. 6 is a diagrammatic view illustrative of the principles of operation of the selvage-knitting needle mechanisms of the present invention.

FIG. 6 illustrates the principles of operation of the selvage-knitting needle mechanisms 10, 36, 50, and 62 shown in FIGS. 1 and 2, 3, 4, and 5, respectively. Given a circle I having a center K and a radius D, a line A is drawn thereacross through a fixed point J on the circle I and a line B is also drawn across the circle I through a point L thereon, forming a vertex with the line A on the circle I, where the lines A, B form an angle $\theta$. As the vertex moves arcuately from points 1 through 6 on the circle I, with the angle $\theta$ unchanged, the line B is caused at all times to pass through the point L. Assuming that the points L, J correspond to the points E, F, respectively, in FIGS. 1 and 2, and the lines A, B, D correspond to the lengths of the support bar 26, needle 21 and lever 46, respectively, the selvage-knitting needle mechanism 10 shown in FIGS. 1 and 2 is effective in enabling the needle 21 to pass through the fixed point E adjacent to the fell 19 of the tape 17 being woven.

Where the line A is constrained to pass successively through points 1'' through 6'' that are spaced an equal distance from the points 1 through 6 as the vertex moves from the points 1 through 6, the points 1'' through 6'' can substantially follow an arc I'' of a circle having a radius G and a center K'' outside of the circle I, and the line B is still caused to pass substantially through the fixed point L. Thus, also assuming that the center K'' and the diameter G correspond to the axis P'' and the length of the lever 42, respectively, in FIG. 3, the needle 37 passes substantically through the fixed point E at all times during operation of the mechanism 36 while the axis O'' of the pin 44 passes through the points 1'' through 6''.

It is assumed that points 1' through 6' are marked on the line A which are spaced an equal distance from the points 1 through 6, and a substantial arc I' is drawn through the points 1' through 6' which is part of a circle having a center K' which is eccentric with respect to the center K of the circle I. A line H is drawn from the center K' to the arc I' forming a vertex with the line A on the arc I'. As the vertex is advanced along the arc I' from the points 1' through 6', the above-mentioned vertex formed by the line A and B is also caused to move through the points 1 through 6, permitting the line B to be directed toward the point L on the circle I. Accordingly, the selvage-knitting needle mechanism 50 illustrated in FIG. 4 can have the needle 51 to reciprocate through the fixed point E provided the length of the lever 59 corresponds substantially to the length H and the point Q corresponds substantially to the vertex by the lines A, B, and also provided the axis P' corresponds to the center K' and the point O' corresponds to the vertex by the lines H, A.

There are further marked points 1''' through 6''' on the line A which are at an equal distance from the points 1' through 6' and on a substantial arc I''' of a circle having a center K''' within the circle I. When a segment of the line A between the points 1', 1''' is shifted laterally through the points 2'–6' and the points 2'''–6''', the vertex by the lines A, B moves from the points 1 through 6, causing the line B to pass through the point L. The needle 63 shown in FIG. 5 therefore can pass through the fixed point E as long as the axis P''' corresponds to the point K''', and the axis O''' has a path of movement corresponding to the arc I'''.

Although various minor modifications might be suggested by those versed in the art, it should be understood that I wish to embody within the scope of the patent warranted hereon, all such embodiments as reasonably and properly come within the scope of my contribution to the art.

I claim as my invention:

1. A selvage-knitting needle mechanism for use in a shutteless loom, comprising:

(a) a support bar;

(b) a selvage-knitting needle attached at an angle to said support bar, said support bar and said needle having their axes crossing at an intersection;

(c) rocker means for angularly moving said support bar to enable said intersection to substantially follow an arc of a circle; and (d) pivot means for allowing said support bar to move longitudinally substantially through a point on said circle while said support bar is being angularly moved.

2. A selvage-knitting needle mechanism according to claim 1, said rocker means comprising a pivotable lever having a distal end thereof pivotably connected to said support bar at said intersection.

3. A selvage-knitting needle mechanism according to claim 1, said pivot means comprising a guide pivotable about an axis located substantially on said circle and having a hole through which said support bar extends and is longitudinally movable.

4. A selvage-knitting needle mechanism according to claim 1, said pivot means comprising a lever angularly movable about an axis disposed out of said circle and having a distal end thereof pivotably connected to said support bar adjacent to said circle.

5. A selvage-knitting needle mechanism according to claim 1, said rocker means comprising a lever pivotable about an axis eccentric with respect to said circle and having a distal end thereof pivotably connected to said support bar remotely from said intersection.

6. A selvage-knitting needle mechanism according to claim 5, said pivot means comprising a lever angularly movable about an axis disposed out of said circle and having a distal end thereof pivotably connected to said support bar adjacent to said circle.

7. A selvage-knitting needle mechanism according to claim 5, said pivot means comprising a lever angularly movable about an axis disposed within said circle and having a distal end thereof pivotally connected to said support bar at a point within said circle.

* * * * *